US005336445A

United States Patent [19]

Michael et al.

[11] Patent Number: 5,336,445

[45] Date of Patent: Aug. 9, 1994

[54] LIQUID HARD SURFACE DETERGENT COMPOSITIONS CONTAINING BETA-AMINOALKANOLS

[75] Inventors: Daniel W. Michael, Cincinnati; Dennis R. Bacon, Milford, both of Ohio

[73] Assignee: The Procter & Gamble Company, Cincinnati, Ohio

[21] Appl. No.: 928,143

[22] Filed: Aug. 11, 1992

Related U.S. Application Data

[63] Continuation of Ser. No. 628,065, Dec. 21, 1990, abandoned, which is a continuation-in-part of Ser. No. 499,858, Mar. 27, 1990, abandoned.

[51] Int. Cl.[5] ..... C11D 1/92; C11D 3/30; C11D 3/34

[52] U.S. Cl. ..... 252/548; 252/545; 252/153; 252/158; 252/DIG. 14; 252/DIG. 10

[58] Field of Search ..... 252/548, 545, 153, 158, 252/DIG. 14, DIG. 10

[56] References Cited

U.S. PATENT DOCUMENTS

| | | | |
|---|---|---|---|
| 3,280,179 | 10/1966 | Ernst | 260/501 |
| 3,309,321 | 3/1967 | McMaster | 252/152 |
| 3,417,025 | 12/1968 | Cooper et al. | 252/152 |
| 3,649,569 | 3/1972 | McCarty | 252/543 |
| 3,679,608 | 7/1972 | Aubert et al. | 252/526 |
| 3,755,559 | 8/1973 | Hewitt | 424/70 |
| 3,840,480 | 10/1974 | Barrat et al. | 252/545 |
| 3,842,847 | 10/1974 | Hewitt et al. | 132/7 |
| 3,849,548 | 11/1974 | Grand | 424/70 |
| 3,893,954 | 7/1975 | Tivin et al. | 252/548 |
| 3,928,065 | 12/1975 | Savino | 134/7 |
| 3,928,251 | 12/1975 | Bolich, Jr. et al. | 252/545 |
| 3,935,130 | 1/1976 | Hirano et al. | 252/542 |
| 3,950,417 | 4/1976 | Verdicchio et al. | 252/545 |
| 3,962,418 | 6/1976 | Birkofer | 424/70 |
| 3,969,043 | 10/1972 | Labarge et al. | 252/153 |
| 3,970,594 | 7/1976 | Claybaugh | 252/524 |
| 4,110,263 | 8/1978 | Lindemann et al. | 252/545 |
| 4,122,043 | 10/1978 | Kersnar et al. | 252/527 |
| 4,148,762 | 4/1979 | Koch et al. | 252/544 |
| 4,181,634 | 1/1980 | Kennedy et al. | 252/545 |
| 4,186,113 | 1/1980 | Verdicchio et al. | 252/526 |

(List continued on next page.)

FOREIGN PATENT DOCUMENTS

| | | | |
|---|---|---|---|
| 88168 | 9/1982 | Australia . | |
| 706408 | 3/1965 | Canada | 260/309.6 |
| 706409 | 3/1965 | Canada | 260/309.6 |
| 0004755 | 10/1979 | European Pat. Off. . | |
| 0024031A1 | 2/1981 | European Pat. Off. . | |
| 0040882A2 | 12/1981 | European Pat. Off. . | |
| 0067635A2 | 12/1982 | European Pat. Off. . | |
| 0106266A2 | 4/1984 | European Pat. Off. . | |
| 0117135A2 | 8/1984 | European Pat. Off. . | |
| 0157443 | 10/1985 | European Pat. Off. . | |
| 0181212 | 5/1986 | European Pat. Off. . | |
| 0205626A1 | 12/1986 | European Pat. Off. . | |
| 0338850 | 10/1989 | European Pat. Off. . | |
| 0373851A2 | 6/1990 | European Pat. Off. . | |

(List continued on next page.)

OTHER PUBLICATIONS

Chem. Abstract 102(22):190818t–P. Busch et al., "Hair–Conditioning Effect of Quar Hydroxypropyl–Trimethylammonium Chloride. Part I.", Parfuem. Kosmet. 1984 65(11), 692, 694–6, 698.

Chem. Abstract 102(22):190819u–P. Busch et al., "Hair–Conditioning Effect of Quar Hydroxypropyl–Trimethylammonium Chloride. Part 2.", Parfuem. Kosmet. 1984 65(12), 756, 758–60.

Chem. Abstract 108(1):5366g–C. A. Bunton, "Micellar Effects on Nucleophilicity," Adv. Chem. Ser. 1987, 215 (Nucleophilicity), 425–41.

Chem. Abstract 115(6):56929v–CTFA, Inc., "Final Report on the Safety Assessment of Cocamidopropyl Betaine," J. Am. Coll. Toxicol. 1991, 10(1), 33–52.

(List continued on next page.)

*Primary Examiner*—Paul Lieberman
*Assistant Examiner*—Erin Higgins
*Attorney, Agent, or Firm*—Robert B. Aylor; Steven J. Goldstein

[57] ABSTRACT

Aqueous, liquid hard surface detergent compositions contain beta-aminoalkanols as solvents and/or buffers for improved spotting/filming and good cleaning. Some formulas do not contain large amounts of builders and are suitable for general purpose cleaning including cleaning of glass.

22 Claims, No Drawings

U.S. PATENT DOCUMENTS

| | | | |
|---|---|---|---|
| 4,233,192 | 11/1980 | Lindemann et al. | 252/545 |
| 4,257,907 | 3/1981 | Langguth et al. | 252/106 |
| 4,259,217 | 3/1981 | Murphy | 252/547 |
| 4,261,869 | 4/1981 | Bishop et al. | 252/542 |
| 4,265,782 | 5/1981 | Armstrong et al. | 252/174.19 |
| 4,287,080 | 9/1981 | Siklosi | 252/104 |
| 4,299,739 | 11/1981 | Esposito et al. | 252/545 |
| 4,329,334 | 5/1982 | Su et al. | 424/70 |
| 4,329,335 | 5/1982 | Su et al. | 424/70 |
| 4,372,869 | 2/1983 | Lindemann et al. | 252/174.16 |
| 4,414,128 | 11/1983 | Goffinet | 252/111 |
| 4,420,484 | 12/1983 | Gorman et al. | 424/326 |
| 4,438,096 | 3/1984 | Preston | 424/70 |
| 4,443,362 | 4/1984 | Guth et al. | 252/545 |
| 4,450,091 | 5/1984 | Schmolka | 252/174.21 |
| 4,452,732 | 6/1984 | Bolich, Jr. | 252/547 |
| 4,477,365 | 10/1984 | Verboom et al. | 252/156 |
| 4,485,029 | 11/1984 | Kato et al. | 252/106 |
| 4,529,588 | 7/1985 | Smith et al. | 424/70 |
| 4,554,098 | 11/1985 | Klisch et al. | 252/547 |

(List continued on next page.)

FOREIGN PATENT DOCUMENTS

| | | |
|---|---|---|
| 00408174A1 | 1/1991 | European Pat. Off. . |
| 274332A3 | 12/1989 | Fed. Rep. of Germany . |
| 275046A1 | 1/1990 | Fed. Rep. of Germany . |
| 4860706 | 8/1973 | Japan . |
| 9189-197A | 10/1984 | Japan . |
| 0141797A | 7/1985 | Japan . |
| 0161498A | 8/1985 | Japan . |
| 0195-200A | 10/1985 | Japan . |
| 1009-500A | 1/1986 | Japan . |
| 1014-298A | 1/1986 | Japan . |
| 1014296A | 1/1986 | Japan . |
| 2252-499A | 11/1987 | Japan . |
| 2257-992A | 11/1987 | Japan . |
| 3012-333A | 1/1988 | Japan . |
| 1092-298A | 4/1989 | Japan . |
| 1135-898A | 5/1989 | Japan . |
| 1153-796A | 6/1989 | Japan . |
| 1221-497A | 9/1989 | Japan . |
| 1221-496A | 9/1989 | Japan . |
| 2269200A | 2/1990 | Japan . |
| 2145697A | 6/1990 | Japan . |
| 2155996A | 6/1990 | Japan . |
| 2296-899A | 12/1990 | Japan . |

(List continued on next page.)

OTHER PUBLICATIONS

N. Parris et al., "Soap Based Detergent Formulations. V. Amphoteric Lime Soap Dispersing Agents," JAOCS, 50(1973) pp. 509–512.

W. R. Noble et al., "Soap-Based Detergent Formulations: X. Nature of Detergent Deposits," JAOCS, 52(1975) pp. 1–4.

N. Parris et al., "Soap-Based Detergent Formulations: XII. Alternate Syntheses of Surface Active Sulfobetaines," JAOCS, 53(1976) pp. 60–63.

F. D. Smith et al., "Soap-Based Detergent Formulations: XV. Amino Esters of alpha-Sulfo Fatty Acids," JAOCS, 53(1976) pp. 69–72.

Parris et al., "Soap-Based Detergent Formulations: XVIII. Effect of Structure Variations on Surface-Active Properties of Sulfur Containing Amphoteric Surfactants", JAOCS, 53(1976) pp. 97–100.

J. K. Weil et al., "Soap-Based Detergent Formulations: XX. The Physical and Chemical Nature of Lime Soap Dispersions," JAOCS, 53(1976) pp. 757–761.

J. K. Weil et al., "The Mutual Solubilization of Soap and Lime Soap Dispersing Agents," JAOCS, 54(1977) pp. 1–3.

T. J. Micich et al., "Soap-Based Detergent Formulations: XIX. Amphoteric Alkyl-succinamide Derivatives as Lime Soap Dispersants," JAOCS, 54(1977) pp. 91–94.

T. J. Micich et al., "Soap-Based Detergent Formulations: XXII. Sulfobetaine Derivatives of N-Alkylglutaramides and Adipamides," JAOCS, 54(1977) pp. 264–266.

N. Parris et al., "Soap Based Detergent Formulation: XXIV. Sulfobetaine Derivatives of Fatty Amides," JAOCS, 54(1977), pp. 294–296.

J. K. Weil et al., "Surface Active Properties of Combinations of Soap and Lime Soap Dispersing Agents," JAOCS, 54(1976) pp. 339–342.

J. M. Kaminski et al., "Soap-Based Detergent Formulations: XXIII. Synthesis of p-Sulfobenzyl Ammonium Inner Salts and Structural Correlation with Analogous Amphoterics," JAOCS. 54(1977) pp. 516–520.

F. D. Smith et al., "Soap-Based Detergent Formulations: XXI. Amphoteric Derivatives of Fatty Amides of (List continued on next page.)

U.S. PATENT DOCUMENTS

| | | | |
|---|---|---|---|
| 4,654,207 | 3/1987 | Preston | 424/70 |
| 4,673,523 | 6/1987 | Smith et al. | 252/91 |
| 4,675,125 | 6/1987 | Sturwold | 252/118 |
| 4,683,008 | 7/1987 | Betts | 134/27 |
| 4,692,277 | 9/1987 | Siklosi | 252/558 |
| 4,772,424 | 9/1988 | Greeb | 252/546 |
| 4,784,786 | 11/1988 | Smith et al. | 252/91 |
| 4,913,841 | 4/1990 | Zeman | 252/352 |
| 4,921,629 | 5/1990 | Malihi et al. | 252/170 |
| 4,948,531 | 8/1990 | Fuggini et al. | 252/544 |
| 5,015,412 | 5/1991 | Zeman | 252/311 |
| 5,061,393 | 10/1991 | Linares et al. | 252/143 |

FOREIGN PATENT DOCUMENTS

| | | |
|---|---|---|
| 3115-495A | 5/1991 | Japan . |
| 3111494A | 5/1991 | Japan . |
| 3153-797A | 7/1991 | Japan . |
| 3163-052A | 7/1991 | Japan . |
| 3215-410A | 9/1991 | Japan . |
| 3258-900A | 11/1991 | Japan . |
| 84944A | 10/1984 | Romania . |
| 1544563 | 4/1979 | United Kingdom . |
| 2193505A | 2/1988 | United Kingdom . |
| WO91/09104 | 6/1991 | World Int. Prop. O. . |
| WO91/1316-10 | 9/1991 | World Int. Prop. O. . |
| WO91/15192 | 10/1991 | World Int. Prop. O. . |

OTHER PUBLICATIONS

Aminoethylethanolamine," JAOCS, 55(1978) pp. 741–744.

J. M. Kaminski et al., "Soap-Based Detergent Formulations: XXV. Synthesis and Surface Active Properties of Higher Molecular Weight Betaine Lime Soap Dispersants," JAOCS, 56(1979) pp. 771–774.

W. M. Linfield, "Soap and Lime Soap Dispersants," JAOCS, 55(1978), pp. 87–92.

W. R. Noble et al., "Soap-Based Detergent Formulations: XXVI. Hard Water Detergency of Soap-Lime Soap Dispersant Combinations with Builders and Inorganic Salts," JAOCS, 57(1980), pp. 368–372.

J. G. Weers et al., "Effect of the Intramolecular Charge Separation Distance on the Solution Properties of Betaines and Sulfobetaines," Langmuir, 1991, vol. 7(5), pp. 854–867 (Abstract only).

T. Takeda et al., "Synthesis and Properties of a,w-bis-(amidopropylhydroxy-sulfobetaine)-type Amphoteric Surfactants," Yukagaku, 1990, vol. 39(8), pp. 576–579 (Abstract only).

Chem. Abstract 115(14):138653q-V. Allikmaa, "Highly Efficient Reversed-Phase HPLC Studies of Amphoteric and Cationic Amido Group-Containing Surfactants," Eesti Tead. Akad. Toim., Keem 1991, 40(1), 67–72.

LIQUID HARD SURFACE DETERGENT COMPOSITIONS CONTAINING BETA-AMINOALKANOLS

This is a continuation of application Ser. No. 07/628,065, filed on Dec. 21, 1990, now abandoned, which is a continuation-in-part application of Ser. No. 07/499,858, filed Mar. 27, 1990, now abandoned.

FIELD OF THE INVENTION

This invention pertains to liquid detergent compositions for use in cleaning hard surfaces. Such compositions typically contain detergent surfactants, solvents, builders, etc.

BACKGROUND OF THE INVENTION

The use of solvents and organic water-soluble synthetic detergents at low levels for cleaning glass are known.

General purpose household cleaning compositions for hard surfaces such as metal, glass, ceramic, plastic and linoleum surfaces, are commercially available in both powdered and liquid form. Liquid detergent compositions are disclosed in Australian Pat. Application 82/88168, filed Sep. 9, 1982, by The Procter & Gamble Company; U.K. Pat. Application GB 2,166,153A, filed Oct. 24, 1985, by The Procter & Gamble Company; and U.K. Pat. Application GB 2,160,887A, filed Jun. 19, 1985, by Bristol-Myers Company, all of said published applications being incorporated herein by reference. These liquid detergent compositions comprise certain organic solvents, surfactant, and optional builder and/or abrasive. The prior art, however, fails to teach, or recognize, the advantage of the specific organic solvents/buffers disclosed hereinafter, in liquid hard surface cleaner formulations.

Liquid cleaning compositions have the great advantage that they can be applied to hard surfaces in neat or concentrated form so that a relatively high level of surfactant material and organic solvent is delivered directly to the soil. Moreover, it is a rather more straightforward task to incorporate high concentrations of anionic or nonionic surfactant in a liquid rather than a granular composition. For both these reasons, therefore, liquid cleaning compositions have the potential to provide superior soap scum, grease, and oily soil removal over powdered cleaning compositions.

Nevertheless, liquid cleaning compositions, and especially compositions prepared for cleaning glass, still suffer a number of drawbacks which can limit their consumer acceptability. Thus, they frequently contain little or no detergency builder salts and consequently they tend to have poor cleaning performance on particulate soil and also lack "robustness" at high water hardness levels. In addition, they can suffer problems of product form, in particular, inhomogeneity, lack of clarity, or inadequate viscosity characteristics, or excessive "solvent" odor for consumer use.

The object of the present invention is to provide detergent compositions which provide good cleaning for the usual general hard surface cleaning tasks found in the house including the removal of hard to remove greasy soils from counter tops and stoves and, preferably, at the same time provide good glass cleaning without excessive filming and/or streaking.

SUMMARY OF THE INVENTION

The present invention relates to an aqueous, liquid, hard surface detergent composition comprising: (a) detergent surfactant; (b) solvent/buffer system that comprises a beta-aminoalkanol which contains from about three to about six carbon atoms; (c) optional detergent builder; and the balance being (d) aqueous solvent system and, optionally, minor ingredients. The composition preferably does not contain large amounts of materials like conventional detergent builders, etc., that deposit on the surface being cleaned and cause unacceptable spotting/filming. The compositions can be formulated at usage concentrations or as concentrates and can be packaged in a container having means for creating a spray to make application to hard surfaces more convenient.

All percentages, parts, and ratios herein are "by weight" unless otherwise stated.

DETAILED DESCRIPTION OF THE INVENTION

In accordance with the present invention, it has been found that aqueous liquid detergent compositions are improved over similar compositions, e.g., those containing alkanolamines such as monoethanolamine, by substituting for the, e.g., monoethanolamine, certain beta-aminoalkanols. Specifically, the beta-aminoalkanol compounds have the formula:

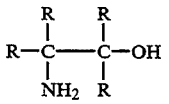

wherein each R is selected from the group consisting of hydrogen and alkyl groups containing from one to four carbon atoms and the total of carbon atoms in the compound is from three to six, preferably four. These compounds serve primarily as solvents when the pH is above about 11.0, and especially above about 11.7. They also provide alkaline buffering capacity during use. These beta-alkanolamines are used at a level of from about 0.05% to about 10%, preferably from about 0.2% to about 5%. For dilute compositions they are typically present at a level of from about 0.05% to about 2%, preferably from about 0,1% to about 1.0%, more preferably from about 0.2% to about 0.7%. For concentrated compositions they are typically present at a level of from about 0.5% to about 10%, preferably from about 1% to about 5%.

The preferred beta-aminoalkanols have a primary hydroxy group. The amine group is preferably not attached to a primary carbon atom. More preferably the amine group is attached to a tertiary carbon atom to minimize the reactivity of the amine group. Preferred beta-aminoalkanols are 2-amino,1-butanol; 2-amino,2-methylpropanol; and mixtures thereof. The most preferred beta-aminoalkanol is 2-amino,2-methylpropanol since it has the lowest molecular weight of any beta-aminoalkanol which has the amine group attached to a tertiary carbon atom. The beta-aminoalkanols preferably have boiling points below about 175° C. Preferably, the boiling point is within about 5° C. of 165° C.

The beta-aminoalkanols are surprisingly better than, e.g., monoethanolamine for hard surface detergent compositions. The beta-aminoalkanols do not adversely affect spotting/filming of hard surfaces. This is especially important for cleaning of, e.g, window glass where vision is affected and for dishes and ceramic surfaces where spots are aesthetically undesirable. In addition, the beta-aminoalkanols provide superior cleaning of hard-to-remove greasy soils and superior product stability, especially under high temperature conditions.

The beta-aminoalkanols, and especially the preferred 2-amino-2-methylpropanol, are surprisingly volatile from cleaned surfaces considering their relatively high molecular weights. Although monoethanolamine has a lower molecular weight, more of it remains on hard surfaces and its spotting/filming characteristics are worse.

The Detergent Surfactant

The aqueous, liquid hard surface detergent compositions (cleaners) herein contain from about 0.1% to about 40% of suitable detergent surfactant. Successively more preferred ranges of surfactant inclusion are from about 1% to about 10% of surfactant, and from about 2% to about 5% of surfactant. Broadly, the surfactants useful for formulation of aqueous liquid cleaners are the usual ones for hard surface cleaners. Some specific surfactants are those in the broad surfactant disclosure of U.S. Pat. No. 4,287,080, Siklosi, issued Sep. 1, 1981, incorporated herein by reference in its entirety.

The detergent surfactant typically falls into the following classes: anionic, cationic, nonionic, zwitterionic and amphoteric surfactants, as set forth at Col. 4 of U.S. Pat. No. 4,287,080, Siklosi, incorporated herein by reference.

Surfactants useful herein include well-known synthetic anionic, nonionic and zwitterionic detergent surfactants. Typical of these are the alkyl- and alkylethoxylate- (polyethoxylate) sulfates, paraffin sulfonates, olefin sulfonates, alkoxylated (especially ethoxylated) alcohols and alkyl phenols, alpha-sulfonates of fatty acids and of fatty acid esters, and the like, which are well-known from the detergency art. In general, such detergent surfactants contain an alkyl group in the $C_9$–$C_{18}$ range. The anionic detergent surfactants can be used in the form of their sodium, potassium or alkanolammonium, e.g., triethanolammonium salts; the nonionics generally contain from about 5 to about 17 ethylene oxide groups. $C_{12}$–$C_{18}$ paraffin-sulfonates and alkyl sulfates, and the ethoxylated alcohols and alkyl phenols are especially preferred in the compositions of the present type. Zwitterionic detergents typically contain both a quaternary ammonium group and an anionic group selected from sulfonate and carboxylate groups.

Another detailed listing of suitable surfactants, of the above types, for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporated herein by reference.

Some suitable surfactants for use in such cleaners are one or more of the following: sodium linear $C_8$–$C_{18}$ alkyl benzene sulfonate (LAS), particularly $C_{11}$–$C_{12}$ LAS; the sodium salt of a coconut alkyl ether sulfate containing 3 moles of ethylene oxide; the adduct of a random secondary alcohol having a range of alkyl chain lengths of from 11 to 15 carbon atoms and an average of 2 to 10 ethylene oxide moieties, several commercially available examples of which are Tergitol 15-S-3, Tergitol 15-S-5, Tergitol 15-S-7, and Tergitol 15-S-9, all available from Union Carbide Corporation; the sodium and potassium salts of coconut fatty acids (coconut soaps); the condensation product of a straight-chain primary alcohol containing from about 8 carbons to about 16 carbon atoms and having an average carbon chain length of from about 10 to about 12 carbon atoms with from about 4 to about 8 moles of ethylene oxide per mole of alcohol; an amide having one of the preferred formulas:

$$R^1-\overset{\overset{\displaystyle O}{\|}}{C}-N(R^2)_2$$

wherein $R^1$ is a straight-chain alkyl group containing from about 7 to about 15 carbon atoms and having an average carbon chain length of from about 9 to about 13 carbon atoms and wherein each $R^2$ is a hydroxy alkyl group containing from 1 to about 3 carbon atoms; a zwitterionic surfactant having one of the preferred formulas set forth hereinafter; or a phosphine oxide surfactant. Another suitable class of surfactants is the fluorocarbon surfactants, examples of which are FC-129, a potassium fluorinated alkylcarboxylate and FC-170-C, a mixture of fluorinated alkyl polyoxyethylene ethanols, both available from 3M Corporation, as well as the Zonyl fluorosurfactants, available from DuPont Corporation. It is understood that mixtures of various surfactants can be used.

For many purposes, synthetic (e.g., nonsoap) detergent surfactants are desirable.

A preferred zwitterionic detergent surfactant has the generic formula:

$$R^3-C(O)-N(R^4)-(CR^5{}_2)_n-N(R^4)_2(+)-(CR^5{}_2)_n-SO_3(-)$$

wherein each $R^3$ is a hydrocarbon, e.g., an alkyl, or alkylene, group containing from about 8 to about 20, preferably from about 10 to about 18, more preferably from about 12 to about 16 carbon atoms, each ($R^4$) is either hydrogen or a short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^5$) is selected from the group consisting of hydrogen and hydroxy groups, and each n is a number from 1 to about 4, preferably from 2 to about 3; more preferably about 3, with no more than about one hydroxy group in any ($CR^5{}_2$) moiety. The $R^3$ groups can be branched and/or unsaturated, and such structures can provide spotting/filming benefits, even when used as part of a mixture with straight chain alkyl $R^3$ groups. The $R^4$ groups can also be connected to form ring structures. These hydrocarbyl amidoalkylene sulfobetaine (HASB) detergent surfactants provide superior grease soil removal and/or filming/streaking and/or "anti-fogging" and/or perfume solubilization properties.

A more preferred detergent surfactant is a $C_{10-14}$ fatty acylamidopropylene(hydroxypropylene)sulfobetaine, e.g., the detergent surfactant available from the Sherex Company under the tradename "Varion CAS Sulfobetaine".

The level of HASB in the composition is typically from about 0.02% to about 20%, preferably from about 0.05% to about 10%, more preferably from about 0.1% to about 5%. The level in the composition is dependent on the eventual level of dilution to make the wash solution. For glass cleaning the composition, when used full strength, or wash solution containing the composition, should contain from about 0.02% to about 1%, preferably from about 0.05% to about 0.5%, more preferably from about 0.1% to about 0.25%, of the HASB. For removal of difficult to remove soils like grease, the level can, and should be, higher, typically from about 0.1% to about 10%, preferably from about 0.25% to about 2%. Concentrated products will typically contain from about 0.2% to about 10%, preferably from about 0.3% to about 5% of the HASB. As discussed hereinbefore, it is an advantage of the HASB that compositions containing it can be more readily diluted by consumers since it does not interact with hardness cations as readily as conventional anionic detergent surfactants. HASB is also extremely effective at very low levels, e.g., below about 1%.

The Cosolvent

In order to obtain good cleaning without any appreciable amount of detergent builder, it is usually necessary to use a cosolvent that has cleaning activity in addition to the beta-aminoalkanol. The cosolvents employed in the solvent/buffer system in the hard surface cleaning compositions herein can be any of the well-known "degreasing" solvents commonly used in, for example, the dry cleaning industry, in the hard surface cleaner industry and the metalworking industry.

A useful definition of such solvents can be derived from the solubility parameters as set forth in "The Hoy," a publication of Union Carbide, incorporated herein by reference. The most useful parameter appears to be the hydrogen bonding parameter which is calculated by the formula $$\gamma H = \gamma T\left[\frac{\alpha - 1}{\alpha}\right]^{1/2}$$

wherein $\gamma H$ is the hydrogen bonding parameter, $\alpha$ is the aggregation number, $$\left(\text{Log}\ \alpha = 3.39066\ T_b/T_c - 0.15848 - \text{Log}\frac{M}{d}\right), \text{ and}$$

$\gamma T$ is the solubility parameter which is obtained from the formula $$\gamma T = \left[\frac{(\Delta H_{25} - RT)d}{M}\right]^{1/2}$$

where $\Delta H_{25}$ is the heat of vaporization at 25° C., R is the gas constant (1.987 cal/mole/deg), T is the absolute temperature in °K., $T_b$ is the boiling point in °K., $T_c$ is the critical temperature in °K., d is the density in g/ml, and M is the molecular weight.

For the compositions herein, hydrogen bonding parameters are preferably less than about 7.7, more preferably from about 2 to about 7, and even more preferably from about 3 to about 6. Solvents with lower numbers become increasingly difficult to solubilize in the compositions and have a greater tendency to cause a haze on glass. Higher numbers require more solvent to provide good greasy/oily soil cleaning.

Cosolvents are typically used at a level of from about 1% to about 30%, preferably from about 2% to about 15%, more preferably from about 4% to about 8%. Dilute compositions typically have cosolvents at a level of from about 1% to about 10%, preferably from about 3% to about 6%. Concentrated compositions contain from about 10% to about 30%, preferably from about 10% to about 20% of cosolvent.

Many of such solvents comprise hydrocarbon or halogenated hydrocarbon moieties of the alkyl or cycloalkyl type, and have a boiling point well above room temperature, i.e., above about 20° C.

The formulator of compositions of the present type will be guided in the selection of cosolvent partly by the need to provide good grease-cutting properties, and partly by aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$–$C_9$ alkyl aromatic solvents, especially the $C_6$–$C_9$ alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal solvents.

Generically, the glycol ethers useful herein have the formula $R^6\ O(R^7O)_mH$ wherein each $R^6$ is an alkyl group which contains from about 3 to about 8 carbon atoms, each $R^7$ is either ethylene or propylene, and m is a number from 1 to about 3. The most preferred glycol ethers are selected from the group consisting of monopropyleneglycol monopropyl ether, dipropyleneglycolmonobutyl ether, monopropyleneglycolmonobutyl ether, diethyleneglycolmonohexyl ether, monoethyleneglycolmonohexyl ether, monoethyleneglycolmonobutyl ether, and mixtures thereof.

A particularly preferred type of solvent for these hard surface cleaner compositions comprises diols having from 6 to about 16 carbon atoms in their molecular structure. Preferred diol solvents have a solubility in water of from about 0.1 to about 20 g/100 g of water at 20° C.

Some examples of suitable diol solvents and their solubilities in water are shown in Table 1.

TABLE 1

Solubility of Selected Diols in 20° C. Water

| Diol | Solubility (g/100 g $H_2O$ |
|---|---|
| 1,4-Cyclohexanedimethanol | 20.0* |
| 2,5-Dimethyl-2,5-hexanediol | 14.3 |
| 2-Phenyl-1,2-propanediol | 12.0* |
| Phenyl-1,2-ethanediol | 12.0* |
| 2-Ethyl-1,3-hexanediol | 4.2 |
| 2,2,4-Trimethyl-1,3-pentanediol | 1.9 |
| 1,2-Octanediol | 1.0* |

*Determined via laboratory measurements.
All other values are from published literature.

The diol solvents are especially preferred because, in addition to good grease cutting ability, they impart to the compositions an enhanced ability to remove calcium soap soils from surfaces such as bathtub and shower stall walls. These soils are particularly difficult to remove, especially for compositions which do not contain an abrasive. The diols containing 8–12 carbon atoms are preferred. The most preferred diol solvent is 2,2,4-trimethyl-1,3-pentanediol.

Solvents such as pine oil, orange terpene, benzyl alcohol, n-hexanol, phthalic acid esters of $C_{1-4}$ alcohols, butoxy propanol, Butyl Carbitol ® and 1(2-n-butoxy-1-methylethoxy)propane-2-ol (also called butoxy propoxy propanol or dipropylene glycol monobutyl ether), hexyl diglycol (Hexyl Carbitol ®), butyl triglycol, diols such as 2,2,4-trimethyl-1,3-pentanediol, and mixtures thereof, can be used. The butoxy-propanol solvent should have no more than about 20%, preferably no more than about 10%, more preferably no more than about 7%, of the secondary isomer in which the butoxy group is attached to the secondary atom of the propanol for improved odor.

The Cobuffer/Alkalinity-Source

The solvent/buffer system is formulated to give a pH in the product and, at least initially, in use of from about 9.5 to about 13, preferably from about 9.7 to about 12, more preferably from about 9.7 to about 11.5. pH is usually measured on the product. The buffering system comprises the beta-aminoalkanol and, optionally, but preferably, cobuffer and/or alkaline material selected from the group consisting of: ammonia; $C_2$–$C_4$ alkanolamines; alkali metal hydroxides; silicates; borates; carbonates; and/or bicarbonates; and mixtures thereof. The preferred cobuffering/alkalinity materials are alkali metal hydroxides. The level of the co-buffer/alkalinity-source is from 0% to about 5%, preferably from 0% to about 5%. The beta-aminoalkanol buffering material, in the system is important for spotting/filming. It is surprising that the beta-aminoalkanol provides improved spotting/filming even in the presence of other buffers, even alkanolamines.

The Aqueous Solvent System

The balance of the formula is typically water and non-aqueous polar solvents with only minimal cleaning action like methanol, ethanol, isopropanol, ethylene glycol, propylene glycol, and mixtures thereof. The level of non-aqueous polar solvent is greater when more concentrated formulas are prepared. Typically, the level of non-aqueous polar solvent is from about 0.5% to about 40%, preferably from about 1% to about 10% and the level of water is from about 50% to about 99%, preferably from about 75% to about 95%.

Optional Ingredients

The compositions herein can also contain other various adjuncts which are known to the art for detergent compositions. Preferably they are not used at levels that cause unacceptable spotting/filming. Nonlimiting examples of such adjuncts are:

Enzymes such as proteases;

Hydrotropes such as sodium toluene sulfonate, sodium cumene sulfonate and potassium xylene sulfonate; and Aesthetic-enhancing ingredients such as colorants and perfumes, providing they do not adversely impact on spotting/filming in the cleaning of glass. The perfumes are preferably those that are more water-soluble and/or volatile to minimize spotting and filming.

Antibacterial agents can be present, but preferably only at low levels to avoid spotting/filming problems. More hydrophobic antibacterial/germicidal agents, like orthobenzyl-para-chlorophenol, are avoided. If present, such materials should be kept at levels below about 0.1%.

Detergent Builder

An optional, but desirable for general cleaning purposes, component of the aqueous liquid cleaners of the present invention is from 0% to about 30%, preferably from about 1% to about 15%, more preferably from about 1% to about 12%, of detergent builder. For use on glass and/or other shiny surfaces, a level of builder of from about 0.1% to about 0.5%, preferably from about 0.1% to about 0.2%, is useful. While any of the builders or inorganic salts can be used herein, some examples of builders for use herein are sodium nitrilotriacetate, potassium pyrophosphate, potassium tripolyphosphate, sodium or potassium ethane-1-hydroxyl-1,1-diphosphonate, the nonphosphorous chelating agents described in the copending U.S. pat. application of Culshaw and Vos, Ser. No. 285,337, filed Dec. 14, 1988, said application being incorporated herein by reference (e.g., carboxymethyltartronic acid, oxydimalonic acid, tartrate monosuccinic acid, oxydisuccinic acid, tartrate disuccinic acid, and mixtures thereof), sodium citrate, sodium carbonate, sodium sulfite, sodium bicarbonate, and so forth.

Other suitable builders are disclosed in U.S. Pat. No. 4,769,172, Siklosi, issued Sep. 6, 1988, and incorporated herein by reference, and chelating agents having the formula:

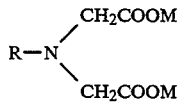

wherein R is selected from the group consisting of:

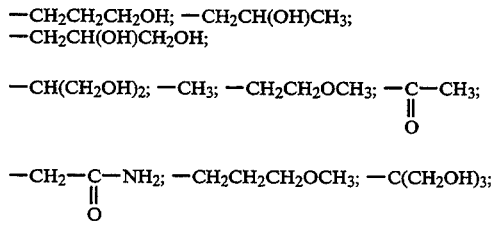

and mixtures thereof;

and each M is hydrogen or an alkali metal ion.

Chemical names of the acid form of some chelating agents useful herein include:

N(3-hydroxypropyl)imino-N,N-diacetic acid (3-HPIDA);

N(-2-hydroxypropyl)imino-N,N-diacetic acid (2-HPIDA);

N-glycerylimino-N,N-diacetic acid (GLIDA);

dihydroxyisopropylimino-(N,N)-diacetic acid (DHPIDA);

methylimino-(N,N)-diacetic acid (MIDA);

2-methoxyethylimino-(N,N)-diacetic acid (MEIDA);

amidoiminodiacetic acid (also known as sodium amidonitrilotriacetic, SAND);
acetamidoiminodiacetic acid (AIDA);
3-methoxypropylimino-N,N-diacetic acid (MEPIDA); and
tris(hydroxymethyl)methylimino-N,N-diacetic acid (TRIDA).

Methods of preparation of the iminodiacetic derivatives herein are disclosed in the following publications:
Japanese Laid Open publication 59-70652, for 3-HPIDA;
DE-OS-25 42 708, for 2-HPIDA and DHPIDA;
Chem. ZUESTI 34(1) p. 93–103 (1980), Mayer, Riecanska et al., publication of Mar. 26, 1979, for GLIDA;
C.A. 104(6)45062 d for MIDA; and
Biochemistry 5, p. 467 (1966) for AIDA.

The levels of builder present in the wash solution used for glass should be less than about 0.5%, preferably less than about 0.2%. Therefore, dilution is highly preferred for cleaning glass, while full strength use is preferred for general purpose cleaning.

Other effective detergent builders, e.g., sodium citrate, sodium ethylenediaminetetraacetate, etc., can also be used, preferably at lower levels, e.g., from about 0.1% to about 1%, preferably from about 0.1% to about 0.5%.

Inclusion of a detergent builder improves cleaning, but harms spotting and filming. The inclusion of detergent builders therefore has to be considered as a compromise in favor of cleaning. In general, inclusion of a detergent builder is optional and low levels are usually more preferred than high levels.

Perfumes

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. It is a special advantage of this invention that perfume ingredients are readily solubilized in the compositions by the acylamidoalkylene detergent surfactant. Other similar detergent surfactants will not solubilize as much perfume, especially substantive perfume, or maintain uniformity to the same low temperature.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. Normally, the art recognized perfume compositions are not very substantive as described hereinafter to minimize their effect on hard surfaces.

In general, the degree of substantivity of a perfume is roughly proportional to the percentages of substantive perfume material used. Relatively substantive perfumes contain at least about 1%, preferably at least about 10%, substantive perfume materials.

Substantive perfume materials are those odorous compounds that deposit on surfaces via the cleaning process and are detectable by people with normal olfactory acuity. Such materials typically have vapor pressures lower than that of the average perfume material. Also, they typically have molecular weights of about 200 or above, and are detectable at levels below those of the average perfume material.

Perfumes can also be classified according to their volatility, as mentioned hereinbefore. The highly volatile, low boiling, perfume ingredients typically have boiling points of about 250° C or lower. Many of the more moderately volatile perfume ingredients are also lost substantially in the cleaning process. The moderately volatile perfume ingredients are those having boiling points of from about 250° C. to about 300° C. The less volatile, high boiling, perfume ingredients referred to hereinbefore are those having boiling points of about 300° C. or higher. A significant portion of even these high boiling perfume ingredients, considered to be substantive, is lost during the cleaning cycle, and it is desirable to have means to retain more of these ingredients on the dry surfaces. Many of the perfume ingredients, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, cis-citral (neral), citronellal, citronellol, citronellyl acetate, paracymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, myrcene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3-cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl citrate, vanillin, and veratraldehyde. Cedarwood terpenes are composed mainly of alpha-cedrene, beta-cedrene, and other $C_{15}H_{24}$ sesquiterpenes.

Examples of the less volatile, high boiling, perfume ingredients are: benzophenone, benzyl salicylate, ethylene brassylate, galaxolide (1,3,4,6,7,8-hexahydro-4,6,6,7,8,8-hexamethyl-cyclopenta-gama-2-benzopyran), hexyl cinnamic aidehyde, lyral (4-(4-hydroxy-4-methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate.

Selection of any particular perfume ingredient is primarily dictated by aesthetic considerations, but more water-soluble materials are preferred, as stated hereinbefore, since such materials are less likely to adversely affect the good spotting/filming properties of the compositions.

These compositions have exceptionally good cleaning properties. They can also be formulated to have good "shine" properties, i.e., when used to clean glossy surfaces, without rinsing.

The compositions can be formulated to be used at full strength, where the product is sprayed onto the surface to be cleaned and then wiped off with a suitable material like cloth, a paper towel, etc. They can be packaged in a package that comprises a means for creating a spray, e.g., a pump, aerosol propellant and spray valve, etc.

The invention is illustrated by the following Example.

EXAMPLE I

| Ingredient | Formula No.* (Wt. %) 1 | 2 | 3 | 4 |
|---|---|---|---|---|
| Propylene Glycol Monobutylether | 2.0 | 2.0 | 2.0 | 2.0 |
| Isopropanol | 5.0 | 5.0 | 5.0 | 5.0 |
| Cocoamidopropyl (Hydroxypropyl)sulfobetaine | 0.15 | 0.15 | 0.15 | 0.15 |
| Monoethanolamine | 1.0 | — | — | — |
| 1-amino-2-propanol | — | 1.0 | — | — |
| 2-amino-1-butanol | — | — | 1.0 | — |
| 2-amino-2-methyl-1-propanol | — | — | — | 1.0 |
| Perfume (High in terpenes) | 0.20 | 0.20 | 0.20 | 0.20 |
| Deionized Water | q.s. | q.s. | q.s. | q.s. |

*pH adjusted to 11.3

In the Example, the following tests were used to evaluate the products' performance.

Preparation of Soiled Panels

Enamel splash panels are selected and cleaned with a mild, light duty liquid cleanser, then cleaned with isopropanol, and rinsed with distilled or deionized water. A specified amount (0.5–0.75 gram per plate) of greasy-particulate soil is weighed out and placed on a sheet of aluminum foil. The greasy-particulate soil is a mixture of about 77.8% commercial vegetable oils and about 22.2% particulate soil composed of humus, fine cement, clay, ferrous oxide, and carbon black. The soil is spread out with a spatula and rolled to uniformity with a standard 3-inch wide, one quarter inch nap, paint roller. The uniform soil is then rolled onto the clean enamel panels until an even coating is achieved. The panels are then placed in a preheated oven and baked at 130°–150° C. for 35–50 minutes. Panels are allowed to cool to room temperature and can either be used immediately, or aged for one or more days. The aging produces a tougher soil that typically requires more cleaning effort to remove.

Soil Removal

A Gardner Straight Line Washability Machine is used to perform the soil removal. The machine is fitted with a carriage which holds the weighted cleaning implement. The cleaning implements used for this testing were clean cut sponges. Excess water is wrung out from the sponge and 1.0–3.0 grams of product are uniformly applied to one surface of the sponge. The sponge is fitted into the carriage on the Gardner machine and the cleaning test is run.

Cleaning Scale Rating Method

This method evaluates the cleaning efficiency of various products and compares them to some reference product. The number of Gardner machine strokes necessary to achieve 95–99% removal of soil are obtained. Then the following formula is used to calculate a product's scale rating.

"Soil Removal" Scale Rating =

$$\frac{1}{\text{\# strokes for test product}} \times 100 \times \text{\# strokes for reference product}$$

This yields a value of 100 for the reference product, and if test product requires fewer strokes than the standard it will have a Scale Rating value >100, if the test product requires more strokes than the standard it will have a Scale Rating value <100.

| Scale Rating Data* | |
|---|---|
| Formula No. | Mean Rating |
| 1 | 100 |
| 2 | 118 |
| 3 | 128 |
| 4 | 125 |

*Four replicates, tough greasy-particulate soil.

The least significant difference between mean ratings is 6 at 95% confidence level.

In this Example, the formulas are also compared using the following test method.

Filming/Streaking Stress Test

Procedure:

A paper towel is folded into eighths. Two milliliters of test product are applied to the upper half of the folded paper towel. The wetted towel is applied in one motion with even pressure from top to bottom of a previously cleaned window or mirror. The window or mirror with the applied product(s) is allowed to dry for ten minutes before grading by expert judges.

Grading:

Expert judges are employed to evaluate the specific areas of product application for amount of filming/streaking. A numerical value describing the amount of filming/streaking is assigned to each product. For the test results reported here a 0–10 scale was used.

0=No Filming/Streaking

10=Poor Filming/Streaking

Room temperature and humidity have been shown to influence filming/streaking. Therefore these variables are always recorded.

| Filming/Streaking Stress Test on Glass Windows (Four Replications at 22° C. and 69% Relative Humidity) | |
|---|---|
| Formula No. | Mean Rating |
| 1 | 8.0 |
| 2 | 5.4 |
| 3 | 2.5 |

-continued

| Filming/Streaking Stress Test on Glass Windows (Four Replications at 22° C. and 69% Relative Humidity) | |
|---|---|
| Formula No. | Mean Rating |
| 4 | 1.2 |

The least significant difference between mean ratings is 0.8 at 95% confidence level.

EXAMPLE II

| Ingredient | Formula No.* (Wt. %) 1 | 2 | 3 |
|---|---|---|---|
| Propylene Glycol Mono-butylether | 2.0 | 2.0 | 2.0 |
| Isopropanol | 4.1 | 4.1 | 4.1 |
| Cocoamidopropyl-dimethyl-ammonium-2-hydroxy-3-sulfopropylbetaine | 0.15 | 0.15 | 0.15 |
| Cocoampho Hydroxypropyl-sulfonate | 0.02 | 0.02 | 0.02 |
| 2-Amino-2-methyl-1-propanol | 0.8 | — | — |
| N-Methyl Pyrrolidone | — | 0.8 | — |
| N-Hydroxyethyl Pyrrolidone | — | — | 0.8 |
| Deionized Water | q.s. | q.s. | q.s. |

*pH adjusted to 11.2

Cleaning Scale Rating Data (three replications, tough greasy-particulate soil)

| Formula No. | Mean Rating |
|---|---|
| 1 | 100 |
| 2. | 48 |
| 3 | 50 |

The least significant difference between mean ratings is 10.1 at 95% confidence level.

EXAMPLE III

| Ingredient | Formula No.* (Wt. %) 1 | 2 | 3 |
|---|---|---|---|
| Lauryl-dimethyl-3-sulfopropylbetaine | 0.20 | — | — |
| Cocoyl-dimethyl-2-hydroxy-3-sulfopropylbetaine | — | 0.20 | — |
| Lauryl-dimethyl-betaine | — | — | 0.20 |
| Cocoamidipropyl-dimethyl-betaine | — | — | — |
| Cocoamidopropyl-dimethyl-2-hydroxy-3-sulfopropylbetaine | — | — | — |
| Sodium Alkyl (~$C_{13}$) Sulfate | — | — | — |
| 2-Amino-2-methyl-1-propanol | 0.5 | 0.5 | 0.5 |
| Propylene Glycol Mono-butylether | 3.0 | 3.0 | 3.0 |
| Isopropanol | 3.0 | 3.0 | 3.0 |
| Deionized Water and Minors (e.g., Perfume) | q.s. | q.s. | q.s. |

| Ingredient | Formula No.* (Wt. %) 4 | 5 | 6 |
|---|---|---|---|
| Lauryl-dimethyl-3-sulfopropylbetaine | — | — | — |
| Cocoyl-dimethyl-2-hydroxy-3-sulfopropylbetaine | — | — | — |
| Lauryl-dimethyl-betaine | — | — | — |
| Cocoamidipropyl-dimethyl-betaine | 0.20 | — | — |
| Cocoamidopropyl-dimethyl-2-hydroxy-3-sulfopropylbetaine | — | 0.20 | 0.18 |
| Sodium Alkyl (~C13) Sulfate | — | — | 0.02 |
| 2-Amino-2-methyl-1-propanol | 0.5 | 0.5 | 0.5 |
| Propylene Glycol Mono-butylether | 3.0 | 3.0 | 3.0 |
| Isopropanol | 3.0 | 3.0 | 3.0 |
| Deionized Water and Minors (e.g., Perfume) | q.s. | q.s. | q.s. |

*pH adjusted to 10.9

What is claimed is:

1. An aqueous liquid hard surface detergent compositions comprising: (a) from about 0.1% to about 40% detergent surfactant; (b) from about 0.05% to about 10% beta-aminoalkanol of the formula:

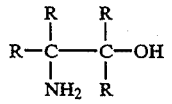

wherein each R is selected from the group consisting of hydrogen and alkyl groups containing from one to four carbon atoms and the total of carbon atoms in the compound is from three to six and optional cosolvent in addition to said beta-aminoalkanol which has cleaning activity and a hydrogen bonding parameter of less than about 7.7 and which, when present, is at a level of from about 1% to about 30%; and (c) the balance being an aqueous solvent system and minor ingredients, said aqueous solvent system comprising water and optional non-aqueous polar solvent having minimal cleaning action selected from the group consisting of methanol, ethanol, isopropanol, ethylene glycol, propylene glycol, and mixtures thereof, and which, when present, is at a level of from about 0.5% to about 40%.

2. The composition of claim 1 wherein said beta-aminoalkanol is 2-amino,2-methylpropanol; 2-amino,1-butanol; or mixtures thereof, at a level of from about 0.05% to about 10%.

3. The composition of claim 2 containing from about 0.2% to about 5% of said 2-amino,2-methylpropanol.

4. The composition of claim 1 wherein (b) comprises at least one of said optional cosolvents.

5. The composition of claim 4 wherein said cosolvent of (b) comprises from about 1% to about 15% of an organic solvent having a boiling point above 20° C.

6. The composition of claim 5 wherein said cosolvent of (b) is selected from the group consisting of alkyl and cycloalkyl hydrocarbons and halohydrocarbons, alpha olefins, benzyl alcohol, pine oil, glycol ethers, and diols containing 6 to 16 carbon atoms.

7. The composition of claim 6 wherein said cosolvent of (b) is a diol containing from about 8 to about 12 carbon atoms.

8. The composition of claim 7 wherein said cosolvent of (b) is 2,2,4-trimethyl-1,3-pentanediol.

9. The composition of claim 6 said cosolvent of (b) contains from about 1% to about 15% of an organic solvent having the formula $R^6O(R^7O)_mH$ wherein each $R^6$ is an alkyl group which contains from about 3 to about 8 carbon atoms, each $R^7$ is selected from the group consisting of ethylene or propylene, and m is a number from 1 to about 3.

10. The composition of claim 9 wherein said cosolvent of (b) is selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

11. The composition of claim 1 wherein said detergent surfactant is selected from the group consisting of anionic, nonionic, and zwitterionic detergent surfactants and mixtures thereof and the level of said detergent surfactant is from about 0.1% to about 40%.

12. The composition of claim 11 wherein the level of detergent surfactant is from about 1% to about 10%.

13. The composition of claim 11 wherein said detergent surfactant comprises from about 0.02% to about 20% hydrocarbyl-amidoalkylene-sulfobetaine which has the formula:

$$R^3—C(O)—N(R^4)—(CR^5{}_2)_n—N(R^4)_2(+)—(CR^5{}_2)_n—SO_3(-)$$

wherein each $R^3$ is an alkyl, or alkylene, group containing from about 10 to about 18 carbon atoms, each ($R^4$) is selected from the group consisting of hydrogen, methyl, ethyl, propyl, hydroxy substituted ethyl or propyl and mixtures thereof, each ($R^5$) is selected from the group consisting of hydrogen and hydroxy groups, and each n is a number from 1 to about 4; with no more than about one hydroxy group in any ($CR^5{}_2$) moiety.

14. The composition of claim 13 wherein said $R^3$ group contains from about 9 to about 15 carbon atoms, the $R^4$ on the amido nitrogen is hydrogen, each $R^4$ on the quaternary nitrogen is methyl, one of the $R^5$ groups between the (+) and the (−) charge centers is a hydroxy group and the remaining $R^5$ groups are hydrogen, and each n is 3.

15. The composition of claim 13 containing at least one co-surfactant in addition to said hydrocarbyl-amidoalkylenesulfobetaine.

16. The composition of claim 13 containing cosolvent of (b) selected from the group consisting of alkyl and cycloalkyl hydrocarbons and halohydrocarbons, alpha olefins, benzyl alcohol, pine oil, glycol ethers, and diols containing 6 to 16 carbon atoms.

17. The composition of claim 16 wherein said cosolvent of (b) contains from about 1% to about 15% of an organic solvent having the formula $R^6O(R^7O)_mH$ wherein each $R^6$ is an alkyl group which contains from about 3 to about 8 carbon atoms, each $R^7$ is selected from the group consisting of ethylene or propylene, and m is a number from 1 to about 3.

18. The composition of claim 1 having a pH of from about 9.5 to about 13.

19. The composition of claim 18 wherein said pH is from about 9.7 to about 12.

20. The composition of claim 18 containing an alkalinity source, other than said beta-aminoalkanol, selected from the group consisting of: ammonia, $C_2$–$C_4$ alkanolamines, alkali metal hydroxides, alkali metal silicates, alkali metal borates, alkali metal carbonates, alkali metal bicarbonates, and mixtures thereof.

21. The composition of claim 20 wherein said alkalinity source is alkali metal hydroxide and said composition has a pH of from about 9.7 to about 12.

22. The composition of claim 1 wherein there is from about 0.1% to about 40% of said detergent surfactant (a); from about 0.05% to about 10% of said beta-aminoalkanol; from about 1% to about 30% of said cosolvent having a hydrogen bonding parameter of less than about 7.7, when such cosolvent is present; and wherein any alkalinity source in addition to said beta-aminoalkanol is present at a level of from 0% to about 5%.

* * * * *